US006332839B2

(12) United States Patent
Walker et al.

(10) Patent No.: US 6,332,839 B2
(45) **Date of Patent: *Dec. 25, 2001**

(54) ELECTRONIC POKER DEVICE AND METHOD FOR OPERATING SAME

(75) Inventors: Jay S. Walker, Ridgefield; James A. Jorasch, Stamford; Magdalena Mik, Wallingford, all of CT (US)

(73) Assignee: Walker Digital, LLC, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/839,854

(22) Filed: Apr. 20, 2001

Related U.S. Application Data

(63) Continuation of application No. 09/047,577, filed on Mar. 24, 1998, now Pat. No. 6,248,016.

(51) Int. Cl.[7] ..... A63F 9/24
(52) U.S. Cl. ..... 463/13; 463/11; 273/293
(58) Field of Search ..... 463/12, 13; 273/292, 273/293

(56) References Cited

U.S. PATENT DOCUMENTS

| | | | | |
|---|---|---|---|---|
| 4,679,143 | | 7/1987 | Hagiwara | 364/412 |
| 4,926,327 | | 5/1990 | Sidley | 364/412 |
| 5,022,653 | | 6/1991 | Suttle et al. | 273/85 CP |
| 5,123,649 | | 6/1992 | Tiberio | 273/143 R |
| 5,294,120 | * | 3/1994 | Schultz | 273/85 CP |
| 5,308,065 | | 5/1994 | Bridgeman et al. | 273/85 CP |
| 5,370,399 | | 12/1994 | Liverance | 273/434 |
| 5,401,023 | | 3/1995 | Wood | 273/85 CP |
| 5,415,404 | | 5/1995 | Joshi et al. | 273/138 A |
| 5,531,440 | | 7/1996 | Dabrowski et al. | 463/12 |
| 5,630,753 | | 5/1997 | Fuchs | 463/9 |
| 6,248,016 | * | 6/2001 | Walker et al. | 463/13 |

OTHER PUBLICATIONS

"Mikohn Gaming Provides Multi–Site Progressive Jackpot Linking Five Widespread Locations in Las Vegas", PR Newswire, Sep. 6, 1996, Financial News Section.

Rose, Bob, "New Ways For The House To Win", St Louis Post–Dispatch, Oct. 3, 1996, Get Out Sections at p. 50.

"Shuffle Master Begins Immediate Rollout of Five Deck Frenzy and Introduces New Version of Let It Ride; Five Deck Frenzy Video and Let It Ride Bonus Games Successfully Complete Test", PR Newswire, Jun. 30, 1997, Financial News Section.

Konik, Michael, "The New Games in Vegas", (http://www cigarficionado com), download date: Feb. 1, 1998.

"Review: Five Deck Frenzy", Shuffle Master and IGT, (http://www pitboss com), download date: Feb. 1, 1998.

"Gambling, The Other Progressive", Las Vegas Advisor, Mar. 1998 at p. 8.

* cited by examiner

*Primary Examiner*—Valencia Martin-Wallace
*Assistant Examiner*—Julie Kasick
(74) *Attorney, Agent, or Firm*—Dean P. Alderucci

(57) ABSTRACT

An electronic gaming device and method for operating the same is disclosed. According to one aspect of the invention, the device is a video poker machine that displays an initial hand of cards to a player. The player considers the initial hand and executes a game strategy by selecting certain of the cards to hold and others to discard, if any. A player's selection of cards causes a signal to be received by the device. The signal indicates which of the of the cards in the initial hand are to be held and which are to be dicarded. Based on the signal, the device determines a number of cards to be drawn. For each discard card, the device displays an additional draw card in place thereof and determines a payout based on a ranking of the final hand and the number of cards drawn.

15 Claims, 5 Drawing Sheets

| FINAL HAND 310 | PAYOUT 0 DRAWN 311 | PAYOUT 1 DRAWN 312 | PAYOUT 2 DRAWN 313 | PAYOUT 3 DRAWN 314 | PAYOUT 4 DRAWN 315 | PAYOUT 5 DRAWN 316 |
|---|---|---|---|---|---|---|
| ROYAL FLUSH | $1000 | $500 | $600 | $1000 | $2000 | $5000 |
| STRAIGHT FLUSH | $75 | $50 | $60 | $80 | $100 | $160 |
| FOUR OF A KIND | $50 | $20 | $25 | $25 | $30 | $40 |
| FULL HOUSE | $15 | $7 | $8 | $9 | $10 | $12 |
| FLUSH | $9 | $5 | $7 | $9 | $12 | $15 |
| STRAIGHT | $7 | $3 | $4 | $7 | $9 | $12 |
| THREE OF A KIND | $4 | $3 | $3 | $4 | $5 | $7 |
| TWO PAIR | $2 | $2 | $2 | $2 | $2 | $2 |
| PAIR JACKS OR BETTER | $1 | $1 | $1 | $1 | $1 | $1 |
| HIGH CARD/LOW PAIR | $0 | $0 | $0 | $0 | $0 | $0 |

10

| | FINAL HAND 15 | PAYOUT 20 |
|---|---|---|
| A | ROYAL FLUSH | $800 |
| B | STRAIGHT FLUSH | $50 |
| C | FOUR OF A KIND | $25 |
| D | FULL HOUSE | $9 |
| E | FLUSH | $6 |
| F | STRAIGHT | $4 |
| G | THREE OF A KIND | $3 |
| H | TWO PAIR | $2 |
| I | ONE PAIR JACKS OR BETTER | $1 |
| J | HIGH CARD/LOW PAIR | $0 |

PRIOR ART

FIG. 1

300

| | FINAL HAND 310 | PAYOUT 0 DRAWN 311 | PAYOUT 1 DRAWN 312 | PAYOUT 2 DRAWN 313 | PAYOUT 3 DRAWN 314 | PAYOUT 4 DRAWN 315 | PAYOUT 5 DRAWN 316 |
|---|---|---|---|---|---|---|---|
| K | ROYAL FLUSH | $1000 | $500 | $600 | $1000 | $2000 | $5000 |
| L | STRAIGHT FLUSH | $75 | $50 | $60 | $80 | $100 | $150 |
| M | FOUR OF A KIND | $50 | $20 | $25 | $25 | $30 | $40 |
| N | FULL HOUSE | $15 | $7 | $8 | $9 | $10 | $12 |
| O | FLUSH | $9 | $5 | $7 | $9 | $12 | $15 |
| P | STRAIGHT | $7 | $3 | $4 | $7 | $9 | $12 |
| Q | THREE OF A KIND | $4 | $3 | $3 | $4 | $5 | $7 |
| R | TWO PAIR | $2 | $2 | $2 | $2 | $2 | $2 |
| S | PAIR JACKS OR BETTER | $1 | $1 | $1 | $1 | $1 | $1 |
| T | HIGH CARD/LOW PAIR | $0 | $0 | $0 | $0 | $0 | $0 |

FIG. 3

ELECTRONIC POKER DEVICE AND METHOD FOR OPERATING SAME

This is a continuation of commonly-owned, co-pending patent application Ser. No. 09/047,577, now U.S. Pat. No. 6,248,016 filed on Mar. 24, 1998 in the name of Walker et al.

BACKGROUND OF THE INVENTION

The present invention relates to an electronic gaming device, such as a video poker machine, and a method for operating the same.

Slot machines generate over ten billion dollars per year in revenue for United States casinos, with individual machines typically earning between fifty and one hundred fifty dollars per day. One of the fastest growing segments of slot machine play is video poker, a game in which various elements of draw poker are played using a computer with a video display.

The basic game of video poker is played on an electronic video poker machine. A player is dealt an initial hand of five cards from a standard deck of fifty-two cards. The five cards are randomly chosen by the processor of the video poker machine and displayed to the player on a video screen. With a goal of maximizing the value of his hand, the player decides which cards, if any, to hold, and which cards, if any, to discard. Given the initial hand, the player may decide to hold all five of his cards. To do this, he presses a button labeled "hold" under each displayed card.

Alternatively, the player may decide to hold a subset of the five cards dealt to him in his initial hand. In this case, the player presses the "hold" button under each card he decides to hold. After the player has decided which cards to hold, he presses a button labeled "deal." This causes the computer to discard the cards that the player has decided not to hold and replace them with draw cards that have been randomly selected from the remaining forty-seven cards of the deck.

After the deal button has been pressed, the ranking of the final hand of the player is evaluated by the computer. If the player's final hand matches a predetermined combination, such as a Full House or Three of a Kind, then the player is awarded a payout in the form of either coins or play credits in accordance with a payout table.

The payout table is stored in a memory of the computer and is also displayed on a schedule printed on the machine or on a video screen for the player to view. The payout for a particular final hand increases with the ranking of the hand. Thus, hands with higher poker rankings are awarded more play credits or coins. For example, very rare poker hands such as a Royal Flush are awarded payouts of 800-to-1 in some game variations.

FIG. 1 depicts a prior art payout database 10 for a "Jacks or Better" video poker game. Such a database is typically stored in a memory of a conventional video poker machine. The payout database 10 includes records A–J, each of which include fields 15 and 20. For ease of reference, a particular location (intersection of a row and column) within this and other tables herein will be referred to by the concatenated field number and record letter. Such locations will be referred to herein as "cells." For example, cell 15A, containing "ROYAL FLUSH," refers to the location defined by field 15 of record A (the intersection of column 15 and row A).

Cells 15A–15J each indicate a final hand that is possible for a player to receive, given an initial hand of five cards.

Cells 20A–20J each indicate a payout (for each $1 wagered) that the associated final hand will pay if it is received. For example, if a player receives a "FULL HOUSE" as a final hand (cell 15D), then the associated payout would be $9 (cell 20D).

A modified video poker machine is described in U.S. Pat. No. 5,401,023 to Wood. According to that patent, a video poker machine is programmed to calculate the expected value of each of the thirty-two possible discard strategies that a player may execute. After a player has selected a discard strategy, the machine adjusts the payouts until the expected value of the executed strategy is nearly equivalent to that of the optimum strategy. In this way, the video poker game is able to provide payouts to players that are not effected by their skill or experience level.

In addition to the games of video poker described above, other variations which include wild cards and jokers are also played, such as "Joker Poker," "Deuces Wild," and "Bonus Poker." Further information on these and other video poker games, payout tables and calculations, and game strategies may be found in Paymar, D., "Video Poker Precision Play," (published by Enhanceware of Las Vegas, Nev.).

Conventional electronic gaming devices configured to play video poker have a number of disadvantages. Specifically, the number of players who can execute perfect or near-perfect game strategies has increased dramatically. This can be attributed to an increase in the number of tutorial materials that teach such game strategies, which materials have become readily available to players via the Internet, commercial software, and books. Further, competition among casinos to attract video poker players has resulted in video poker machines being programmed to pay out in excess of 100% (assuming perfect playing strategy), which has provided additional incentive for players to learn game strategies from the tutorial materials. The foregoing has increased the aggregate amount of payouts to players and thus decreased profits for the casinos.

Additionally, players initially were attracted to conventional video poker games because of the requirement for the players to use analytical thought and decision making during game play. However, game strategies have not changed much since the introduction of video poker. Indeed, conventional video poker machines do not offer players a chance to execute more complex and non-conventional strategies in order to obtain higher payouts. Consequently, some players have become bored with, and thus lost interest in, conventional video poker games.

In view of the above, there is a substantial need for an electronic gaming device such as a video poker machine, and method for operating the same, that enables casinos to increase revenue and, at the same time, is more interesting for players to play.

SUMMARY OF THE INVENTION

A first aspect of the present invention is directed to a method for directing a computing device to conduct a game of chance. According to the inventive method, the device displays a plurality of game indicia to a player. In one embodiment, the game indicia are cards from a standard deck of playing cards. The device receives a signal representing a selection of game indicia by the player. The game indicia might be selected by the player using, for example, buttons or a touch screen device. The device determines a number of the selected game indicia based on the signal and determines a ranking for the game of chance based on the displayed game indicia. In a preferred embodiment, the game of chance is a video poker game with hand rankings such as "Full House" or "Straight." The device further determines a payout based on the number and ranking.

A second aspect of the present invention is directed to a method for operating a video poker gaming device. The device displays an initial hand of cards to a player. The device receives a signal representing a selection of discard cards and held cards and determines a number of cards to be drawn based on the signal. The device displays a draw card in place of each discard card such that the held cards and draw cards make up the final hand of the player. The device determines a ranking of the final hand and a payout. The payout is based on the ranking and the number of cards drawn. In another embodiment, the payout may further be based on an amount of money that the player has wagered for the game.

It is an advantage of the present invention that a player may execute more complex and non-conventional game strategies as compared to those executed with respect to prior art gaming devices, in order to attempt to obtain a higher payout or to maximize the long term payback of the hand. It is another advantage of the present invention that casinos may experience increased profits because players are unlikely to execute near perfect game strategies due to the increased game complexity. The above advantages and other objects, features, and advantages are readily apparent from the detailed description when taken in connection with the accompanying drawings.

BRIEF DESCRIPTION OF THE DRAWINGS

Representative embodiments of the present invention will be described with reference to the following figures:

FIG. 1 depicts a payout table that is used with conventional electronic video poker games;

FIG. 3 depicts a table that is used in determining payouts in accordance with the present invention;

DETAILED DESCRIPTION OF THE PREFERRED EMBODIMENTS

Reference is now made to the accompanying Figures for the purpose of describing, in detail, the preferred embodiments of the present invention. The Figures and accompanying detailed description are provided as examples of the invention and are not intended to limit the scope of the claims appended hereto.

Figure 2:
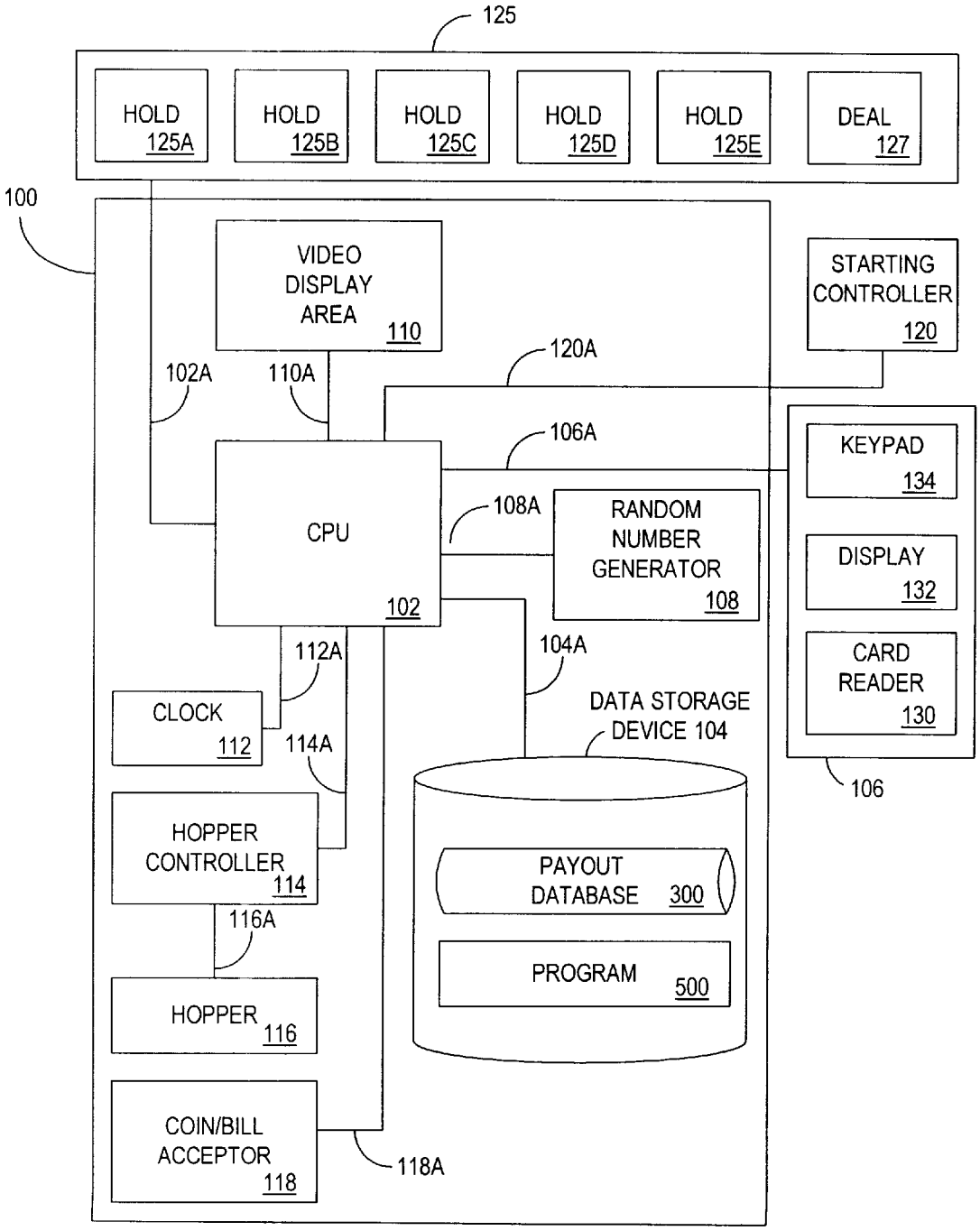
FIG. 2 is a block diagram of a video poker gaming device provided in accordance with the present invention.

In accordance with the present invention there is provided an electronic gaming device and method for operating the same, illustrated by way of a video poker gaming device. Referring now to FIG. 2, there is shown a block diagram of a video poker gaming device 100, which includes a central processing unit (CPU) 102 and a data storage device 104 in communication therewith via line 104A. A player card tracking device 106, a random number generator 108, a video display area 110, a clock 112, a hopper controller 114, a coin/bill acceptor 118, and a starting controller 120 are in communication with CPU 102 via lines 106A, 108A, 110A, 112A, 114A, 118A, and 120A, respectively. A hopper 116 is under control of hopper controller 114 via line 116A. A player input panel 125 is in communication with CPU 102 via line 102A.

Video poker gaming device 100 may comprise conventional components, with the exception of payout database 300 and program 500. For purposes of better illustrating the invention, the conventional components, which are well known to those skilled in the art, are described only briefly. Although the described embodiment of the present invention is described as implemented with physical hardware components, the present invention contemplates software embodiments such as would be implemented on the Internet and other computer communication networks.

Still referring to FIG. 2, CPU 102 comprises a well known processing unit, for example, a Pentium® microprocessor manufactured by Intel Corp. of Santa Clara, Calif. Data storage device 104 typically includes one or more machine readable media. Such media include an appropriate combination of semiconductor, magnetic and optical media. In addition to payout database 300 and program 500, data storage device 104 stores appropriate operating system and control software (not shown), each functional to facilitate operation of video poker gaming device 100 as will be understood by those skilled in the art.

Player card tracking device 106 comprises a player tracking interface including a card reader 130 for receiving a player tracking card, a display 132 for communicating alphanumeric messages to a player, and a keypad 134 for receiving player input such as a player identification number/code.

Random number generator 108 comprises a random or pseudo-random number generator suitable for use in a gaming device. Clock 112 comprises a clock for providing timing signals to CPU 102. Hopper controller 114, and hopper 116 connected thereto, are operative under the control of CPU 102 to dispense and provide coins to a player. Coin/Bill acceptor 118 is operative to receive one or more coins or bills, and to transmit an appropriate value signal to CPU 102 indicating the monetary amount wagered.

Player input panel 125 includes a plurality of buttons 125A–125E and 127. In the video poker gaming device of the present embodiment, buttons 125A–125E each are labeled "hold." Using buttons 125A–125E a player may select which cards from an initial hand of cards he desires to hold, if any. Accordingly, cards which a player does not desire to hold are to be discarded. Button 127 is labeled "deal" and is used to indicate when a player has completed selecting which cards to hold. A signal indicating which cards have been selected by a player is transmitted from player input panel 125 to CPU 102 via line 102A.

In an alternate embodiment, buttons 125A–125E are used to select the cards that the player wants to discard, with the signal similarly transmitted to CPU 102 via line 102A. Video display 110 preferably comprises a conventional video display device, for example, a cathode ray tube or a liquid crystal display screen. Alternatively, video display 110 may comprise a touch sensitive screen capable of processing player selections through tactile input. Of course, in this alternative embodiment, buttons 125A–125E and 127 are not required because they can be implemented using the touch sensitive screen. Starting controller 120 comprises a player-operated device such as a handle or button for initiating play of a game.

Gaming device 100 may include a conventional network interface (not shown) for communicating with a central network server thus allowing for the remote monitoring and auditing of gaming device 100.

Referring next to FIG. 3, payout database 300 is represented by a payout table that associates each of a plurality of final hands (e.g., a "FULL HOUSE") with a particular payout. The payouts stored in payout database 300 are provided for each $1 wagered. Unlike the prior art, in which the association of a payout and a final hand is based on the number of coins that a player wagers and the ranking of the final hand, the present invention determines a particular payout based on an additional factor (i.e., the number of cards that a player draws to obtain the final hand). Determining the payout in this manner allows players to execute more complex and non-conventional game strategies in order to obtain higher payouts, as compared to those executed when playing conventional video poker games. This will increase player interest in the inventive video poker gaming device and method. Also, because more complex game strategies are involved, the players are not easily able to execute perfect or near-perfect game strategies. As a consequence, casinos will experience a decrease in the aggregate amount of payouts and thus an increase in profits.

The rows and columns of the payout database 300 represent records and fields thereof, respectively. It is noted that while the following description refers to specific individual databases, formats, records, and fields, those skilled in the art will readily appreciate that various modifications and substitutions may be made thereto without departing from the spirit and scope of the present invention.

For exemplary purposes, payout database 300 is shown to include seven fields 310–316. Field 310 stored data indicating a ranking of a final hand that a player may obtain, given an initial hand of five cards. Thus, in this embodiment, it is possible for a player to obtain a "ROYAL FLUSH," "STRAIGHT FLUSH," "FOUR OF A KIND," "FULL HOUSE," "FLUSH," "STRAIGHT," "THREE OF A KIND," "TWO PAIR," "PAIR OF JACKS OR BETTER," or "HIGH CARD/LOW PAIR." Of course, other final hands, such as those incorporating jokers, wild cards, or specific card bonuses are deemed to be within the scope of the present invention.

Fields 311–316 store data indicating a payout for a final hand, which payout is based on the ranking of the final hand and on the number of cards that a player draws to obtain the final hand. Thus, field 311 indicates a payout for a final hand in which a player has not drawn any cards—i.e., the player stands with the initial hand. Similarly, fields 312–316 indicate a payout for a final hand in which a player has drawn 1, 2, 3, 4, or 5 cards, respectively, to obtain the final hand. The payout may be adjusted to reflect the number of coins wagered by the player, with bonuses provided for maximum coin wagers as is well known in the art.

For example, record M stores data for a payout in which the final hand is "FOUR OF A KIND" (cell 310M). In this case, if a player has been dealt FOUR OF A KIND and chooses not to draw any cards, the payout would be $50 (cell 311M). Similarly, if a player has been dealt an initial hand and draws 1, 2, 3, 4, or 5 cards to obtain FOUR OF A KIND, the payout would be $20, $25, $25, $30, and $40 (cells 312M–316M), respectively.

To illustrate further, consider a player who is dealt an initial hand comprising the Nine of hearts (9*h*), Nine of diamonds (9*d*), Two of spades (2*s*), Six of hearts (6*h*), and Jack of hearts (J*h*). In a conventional Jacks or Better video poker gaming device, a player would (and should) normally elect to hold the pair of nines (9*h*-9*d*) and draw three cards. This strategy may be employed in an attempt to obtain a hand such as THREE OF A KIND or FOUR OF A KIND for a payout of $3 or $25, respectively, as illustrated by cells 20G and 20C of FIG. 1. A player would not usually draw two cards in an attempt to obtain a flush because such a play results in a lower expected value. This is because the average return or expected value of holding the pair (9*h*-9*d*) is significantly greater than the average return of holding the three hearts (9*h*-6*h*-J*h*). While the average return of holding the pair is $0.82 for each dollar coin wagered, holding the three hearts results in an average return of $0.43 for each dollar coin wagered. The player is thus giving up almost forty cents per dollar coin wagered every time that he draws to the three hearts.

In the video poker gaming device of the present invention, however, a player is encouraged to draw two cards in an attempt to obtain a flush because he is tempted by the $7 payout (see cell 313O). The possibility of obtaining this higher payout, as compared to a $6 payout for a flush in a conventional video poker machine, will serve to increase player interest in the game because the player is given an opportunity to execute more complex and non-conventional game strategies in order to obtain a higher payout, as compared to prior art electronic gaming devices. Players who elect to hold the three hearts in the hopes of attaining the $7 payout, however, are technically making a poor wagering decision.

While the expected value of holding the three hearts has increased from $0.43 to $0.47, the expected value of holding the pair of nines remains at $0.82 and is thus the superior decision. As one of ordinary skill in the art can appreciate, by increasing the payout for two card draws to flushes, players enjoy a wider range of plays they may find acceptable. By changing the payout table, plays that were once too speculative (e.g. three card straight flush draws) may now fall within an acceptable range of average return for those players looking for the excitement of larger, less frequent payouts. By convincing a player to make a lower expected value play, the casino's advantage is increased.

Figure 4:
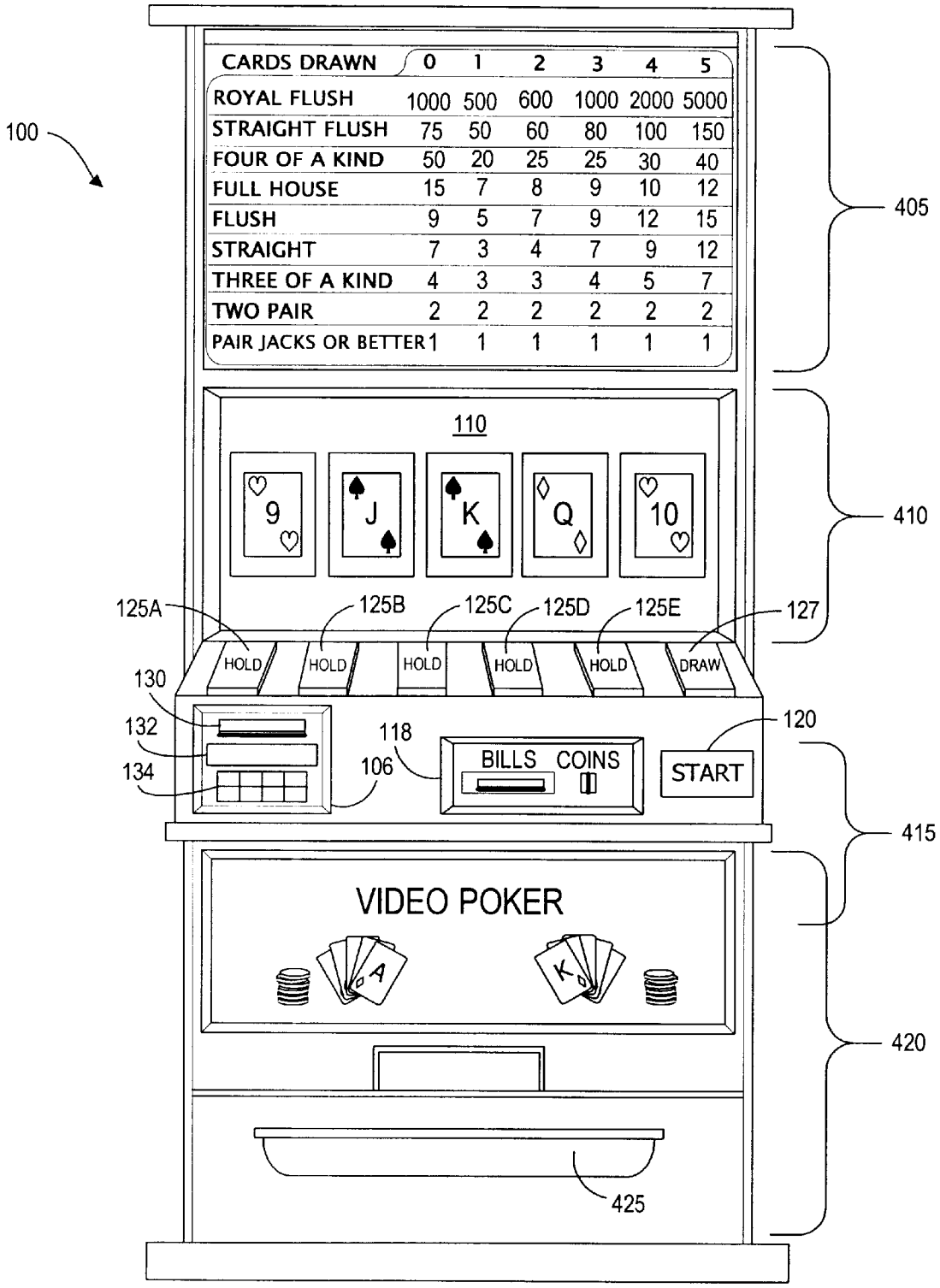
FIG. 4 is a plan view of a video poker gaming device provided in accordance with the present invention.

The profitability derived from the inventive video poker gaming device is directly related to the values stored in payout fields 311–316, although player skill levels will also have an impact on profitability. In addition to basing a payout on the number of cards drawn to obtain a final hand, it is preferred that the payout values be set so that perfect play results in a small advantage for the casino and average play results in a reasonable payout to a player. Thus, in described embodiments, the payout is set to generally increase as the number of cards drawn increases from one to five. For example, record K stores data for a final hand that is a ROYAL FLUSH (cell 310K). In this case, it is seen that the payout for obtaining the ROYAL FLUSH is $500, $600, $1000, $2000, and $5000 for drawing 1, 2, 3, 4, and 5 cards, respectively (cells 312K–316K). Similarly, record Q stores data for a final hand that is a THREE OF A KIND (cell 310Q). It is seen that the payout for obtaining this final hand generally increases as the number of draw cards increases, paying $3, $3, $4, $5, and $7 for drawing 1, 2, 3, 4, and 5 cards (cells 312Q–316Q), respectively. Of course, the foregoing payouts have been described for exemplary purposes. Accordingly, the payout values stored in the fields 311–316 may be set as desired. Referring now to FIG. 4, a plan view is shown of gaming device 100 of the present invention which, for purposes of discussion, is generally divided into four sections: an upper panel 405, a display panel 410, an interface panel 415, and a lower panel 420.

Upper panel 405 includes a diagram depicting a payout table for the gaming device. The values should correspond to the payouts stored in payout database 300 and may be printed on glass with a back lighting scheme for maximum player visibility.

Display panel 410 contains video display area 110, which displays a player's cards. Interface panel 415 includes starting controller 120, player tracking device 106 (including card reader 130, display 132, and keypad 134), and coin/bill acceptor 118. Lower panel 420 includes promotional messages which may serve to attract players to the game or to provide rules/instructions concerning operation of the game, and a coin tray 425.

Figure 5:
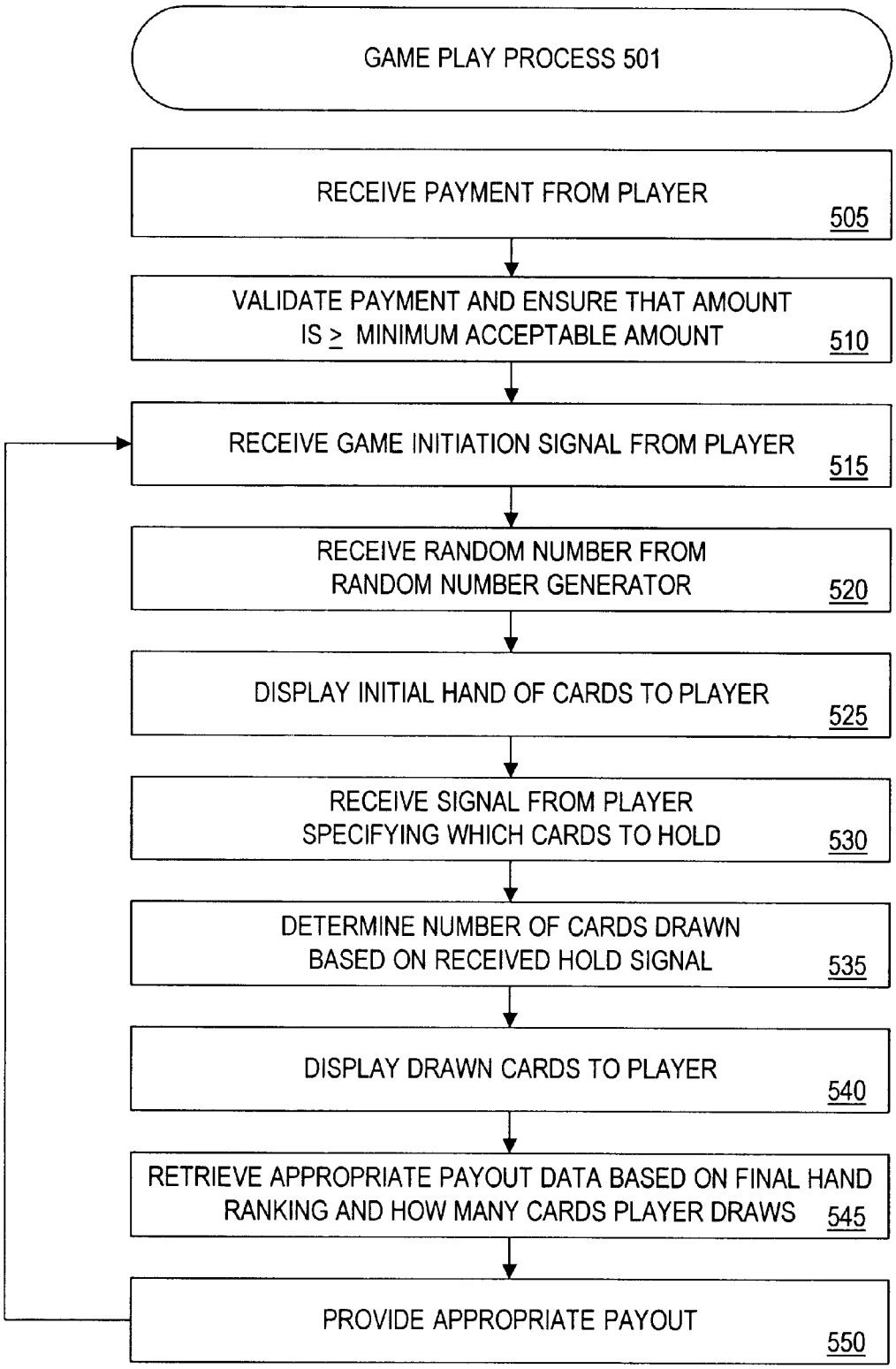
FIG. 5 is a flowchart illustrating a method for operating a video poker gaming device in accordance with the present invention.

Referring again to FIG. 2, data storage device 104 also includes program 500. Program 500 comprises computer instructions and/or data, executable or otherwise, for executing the functionality of the present invention. FIG. 5 depicts game play process 501 that may be embodied by such a program 500 for operating a video poker gaming device in accordance with the present invention.

At step 505, the video poker gaming device 100 receives payment from a player. In the described embodiment, the player inserts bills or coins into bill/coin acceptor 118. The appropriate signals are communicated to CPU 102 via line 118A to indicate a monetary amount that is being wagered.

At step 510, CPU 102 validates the payment received at step 505 and ensures that the payment received is greater than or equal to a minimum acceptable amount.

At step 515, the video poker gaming device 100 receives a game initiation signal from a player. Thus, when a player activates starting controller 120, such as by depressing a button labeled "START" or pulling a lever (not shown), an appropriate game initiation signal is communicated to CPU 102 via line 120A.

Processing continues at step 520 where CPU 102 receives a random number from random number generator 108 via line 108A. As is well known, the random number acts as a seed from which a player will be dealt an initial hand of cards from a standard deck of fifty-two playing cards.

At step 525, CPU 102 displays an initial hand of cards to a player. In this embodiment, CPU 102 generates a plurality of cards (e.g., 10) using the random number received at step 520. The initial hand, in the form of certain of the plurality of cards, is displayed to a player via video display area 110.

At step 530, CPU 102 receives a signal indicating which cards have been selected by a player. In this video poker embodiment, the selected cards indicate those which a player has decided to hold and therefor also indicates those which the player has discarded. A player may select the cards by depressing one or more of the hold buttons 125A–125E. A signal indicating which cards a player has decided to hold is communicated to CPU 102 via line 102A after deal button 127 is depressed.

At step 535, CPU 102 determines the number of cards that a player has decided to draw. This is done by subtracting the number of cards that a player has decided to hold, as indicated by the signal received at step 530, from the number of cards in the initial hand of cards.

For each card that a player has decided to discard, CPU 102 displays on video display area 110 an additional draw card in place thereof at step 540. The draw cards are chosen by CPU 102 from the remaining five cards that were selected at step 525. The cards that a player has decided to hold from the initial hand dealt at step 525 and the additional draw cards make up the final hand of the player for which a ranking and payout will be determined.

At step 545, CPU 102 determines a payout to a player based on the number of cards that a player has decided to draw, as determined at step 535. In this embodiment, CPU 102 determines the ranking of the final hand (i.e., which of the final hands 310K–310T a player has obtained), and accesses the record in payout database 300 that corresponds to that ranking. CPU 102 reads the payout value from the field 310–316 of the accessed record that corresponds to the number of cards that a player has drawn. The payout value may of course be adjusted to reflect the number of coins wagered by the player.

At step 550, CPU 102 causes the payout determined at step 545 to be provided to the player. In this embodiment, hopper 116 dispenses a coin payout (or play credits) to the player under the control of hopper controller 114, which is under control of CPU 102. Processing then may return to step 515 so that a player may play another game.

While the foregoing embodiments have been described with reference to a video poker gaming device, it is contemplated that other electronic gaming devices and methods of operating the same may be used in according with the teachings of this disclosure.

In view of the foregoing, an electronic gaming device and method for operating the same has been described in which a payout is determined based on the number of cards that a player draws to obtain a final hand. This is neither taught nor suggested in the prior art which simply determines a payout based on the ranking of the final hand and a number of coins that a player wagers. Determining the payout in this manner will make the game more interesting for players because they will be given the opportunity to execute a variety of complex and non-conventional games strategies and also will enable casinos to increase profits because the players will not be able to readily play perfect or near-perfect due to the increased complexity.

Although the particular embodiments shown and described above will prove to be useful in many applications relating to the arts to which the present invention pertains, further modifications of the present invention herein disclosed will occur to persons skilled in the art.

What is claimed is:

1. An apparatus, comprising:

a storage device; and a processor in communication with the storage device, the storage device storing a program for controlling the processor; and the processor operative with the program to:

display a hand of cards on a display screen of a video poker machine;

receive a signal via an input device of the video poker machine that indicates cards of the hand that a player wants to discard;

determine a quantity of draw cards to provide based on the number of cards the player wants to discard;

provide the quantity of draw cards via the display screen; and determine a payout based at least upon the quantity of draw cards provided.

2. The apparatus of claim 1, wherein the apparatus comprises a video poker gaming device.

3. The apparatus of claim 1, wherein the processor is operative with the program to:

determine a payout by accessing a database based on the quantity of draw cards provided and wherein the database includes at least one entry for each possible quantity of draw cards provided.

4. The apparatus of claim 1 wherein the processor is further operative with the program to:

display a payout table that specifies payouts based upon the quantity of draw cards provided.

5. The apparatus of claim 1, wherein the hand of cards includes five cards from a standard deck of playing cards.

6. The apparatus of claim 1, wherein the determined quantity of cards to provide includes a quantity of cards to provide between zero and five, inclusive.

7. The apparatus of claim 1, wherein the processor is further operative with the program to:

determine a payout by accessing a database based on the quantity of draw cards provided and wherein the database includes at least one entry for zero draw cards provided.

8. The apparatus of claim 1, wherein the processor is further operative with the program to:

determine a payout by accessing a database based on the quantity of cards provided, wherein the database includes entries for each possible quantity of draw cards provided, and wherein the entries specify relatively larger payouts for larger quantities of draw cards provided and relatively smaller payouts for smaller quantities of draw cards provided.

9. The apparatus of claim 1, wherein the processor is further operative with the program to:

provide the payout to the player.

10. The apparatus of claim 1, wherein the processor is operative with the program to:

determine a payout based at least upon the quantity of draw cards provided and on an amount of money that the player has wagered.

11. A medium encoded with a program for directing a device to perform the steps of:

display a hand of cards on a display screen of a video poker machine;

receiving a signal via an input device of the video poker machine that indicates cards of the hand that a player wants to discard;

determining a quantity of draw cards to provide based on the number of cards the player wants to discard;

providing the quantity of draw cards via the display screen; and determining a payout based at least upon the quantity of draw cards provided.

12. The medium of claim 11, wherein the step of determining a payout comprises:

determining a payout based at least upon the quantity of draw cards provided and on an amount of money that the player has wagered.

13. An apparatus, comprising:

a storage device; and a processor in communication with the storage device, the storage device storing a program for controlling the processor; and the processor operative with the program to:

display five cards to a player via a display screen;

receive input from the player indicating which of the five cards the player wants to hold;

display a quantity of draw cards to the player, the quantity being based on a difference between five and a number of the cards the player wants to hold; and determine a payout based upon at least the quantity of draw cards displayed to the player.

14. A medium encoded with a program for directing a device to perform the steps of:

displaying five cards to a player via a display screen;

receiving input from the player indicating which of the five cards the player wants to hold;

displaying a quantity of draw cards to the player, the quantity being based on a difference between five and a number of the cards the player wants to hold; and determining a payout based upon at least the quantity of draw cards displayed to the player.

15. A medium encoded with a program for directing a device to perform the steps of:

providing a hand of cards;

receiving an indication of cards to discard;

determining a quantity of draw cards to provide based on the indication of cards to discard;

providing the quantity of draw cards; and determining a payout based at least upon the quantity of draw cards provided.

* * * * *